US005704673A

United States Patent [19]

Reckart

[11] Patent Number: 5,704,673

[45] Date of Patent: Jan. 6, 1998

[54] LARGE AREA SUPPORT LABEL CARRIER

[75] Inventor: Mitchell R. Reckart, Chardon, Ohio

[73] Assignee: Avery Dennison Corporation, Painesville, Ohio

[21] Appl. No.: 249,147

[22] Filed: May 25, 1994

[51] Int. Cl.[6] ..... B25J 15/06

[52] U.S. Cl. ..... 294/64.1; 271/90; 901/40

[58] Field of Search ..... 294/64.1, 65; 248/362, 248/363; 264/509; 269/21; 271/11, 14, 190, 94, 96, 107; 414/627, 737, 752, 797; 425/504; 901/40

[56] References Cited

U.S. PATENT DOCUMENTS

| | | | |
|---|---|---|---|
| 2,317,348 | 4/1943 | Wekeman | 269/21 X |
| 2,723,775 | 11/1955 | von Hofe et al. | 269/21 X |
| 3,183,032 | 5/1965 | Warfel | 294/65 |
| 3,195,941 | 7/1965 | Morey | 294/64.1 |
| 3,580,221 | 5/1971 | Noyes | 294/65 X |
| 3,640,562 | 2/1972 | Creskoff | 294/64.1 X |
| 3,833,251 | 9/1974 | Creskoff | 294/64.1 |
| 3,955,843 | 5/1976 | Ottenhues et al. | 294/65 X |
| 4,479,770 | 10/1984 | Slat et al. . | |
| 4,549,863 | 10/1985 | Bourgeois . | |
| 4,605,462 | 8/1986 | Lehner . | |
| 4,708,630 | 11/1987 | Hammond . | |
| 4,931,341 | 6/1990 | Haffer et al. | 294/64.1 X |
| 4,987,332 | 1/1991 | Yamamoto et al. . | |
| 5,026,266 | 6/1991 | Takasaki et al. . | |
| 5,037,080 | 8/1991 | Wirz . | |
| 5,076,564 | 12/1991 | Marass . | |
| 5,192,070 | 3/1993 | Nagai et al. | 294/64.1 X |

FOREIGN PATENT DOCUMENTS

| | | | |
|---|---|---|---|
| 2547289 | 12/1984 | France | 294/64.1 |
| 256952 | 5/1988 | Germany | 269/21 |
| 46529 | 4/1981 | Japan | 269/21 |
| 206643 | 8/1989 | Japan | 269/21 |

*Primary Examiner*—Johnny D. Cherry
*Attorney, Agent, or Firm*—Renner, Otto, Boisselle & Sklar, P.L.L.

[57] ABSTRACT

The invention relates to a device for transferring thin sheet material which comprises: a face, a spine which is positioned adjacent to the face, a plurality of ribs which radiate away from the spine and are used to support the face, an apparatus for connecting the device to a machine arm, and a mechanism for providing vacuum over a substantial portion of a thin sheet material, wherein the face is configured in the same shape as the thin sheet material.

15 Claims, 2 Drawing Sheets

LARGE AREA SUPPORT LABEL CARRIER

TECHNICAL FIELD OF THE INVENTION

The present invention relates generally, as is indicated, to an apparatus including a carrier for holding thin sheet material while carrying the material from one position to another position. More particularly, this invention relates to an apparatus for picking up a label from a label magazine, carrying this label in a relatively flat position, and accurately placing the label within the mold of a blow molding machine.

BACKGROUND OF THE INVENTION

A conventional blow molding machine extrudes a parison (plastic tube) between open sections of a mold to make a container. Closing of the mold sections clamps the parison and allows air to be blown into the parison such that it will assume the shape of the mold which defines the container shape. The newly formed container is allowed to cool, at which time the mold sections are opened, and the molded container is ejected.

In-mold labeling has been developed in order to overcome problems experienced with paper labels glued to the container. In-mold labeling is performed by inserting a label within the mold prior to extrusion of the parison and subsequent closing of the mold sections. The blowing operation then forms the parison around the label and activates a heat sensitive adhesive. This operation provides a permanent bond between the label and the container, and also provides a smooth transition between the label and the surface of the container.

Prior improvements in this field have been directed to the apparatus that moves the label carrier, and therefore the label, from the label magazine to the mold. The industry has paid little attention to drawbacks associated with the label carrier itself.

Some prior in-mold label transfer devices have used suction or vacuum cups to pick up a label from a label supply cassette and to retain the label during the process of transferring the label from the supply cassette to the respective mold section. However, due to the curvature of the cup a deformation in the label can occur. This can result in a misplaced or misaligned label or distortion of the label, which reduces the quality of the finished molded product and, thus, is a severe drawback for the labeling industry.

Other in-mold label dispensers, such as the one disclosed in U.S. Pat. No. 4,549,863, have opted for a small flat label carrier containing small holes for application of the suction or vacuum. Although the label holder is flat, its surface area is small in comparison to the label. Therefore, the label carrier only provides suction or vacuum to a small portion of the label, which means that deformations in the label still can occur. Additionally, the label carrier is made from a rigid material which does not conform to the shape of the label or to the wall of the mold. Once again, this can cause errors in the accuracy of the placement of the label. In addition, the rigid material of the label carrier can cause scoring on the walls of the mold.

SUMMARY OF THE INVENTION

It is an object of the present invention to overcome the drawbacks noted above, and, to this end, this invention relates to an improved apparatus for holding a label or thin sheet material (hereinafter collectively referred to as "label" for simplicity) during transfer of the label to a mold and for depositing the label onto the wall of that mold.

This improved apparatus for holding the label during transfer and deposition has a unibody, i.e., one piece, construction and is comprised of the following:

- a spine for flexible support of the apparatus, which may contain means for connecting the apparatus to the appropriate machinery, and may also contain a passageway which provides a flowpath for vacuum;
- a plurality of ribs for further flexible support of the apparatus, which radiate from the spine to the edge of the apparatus;
- a face, the backside of which contains the spine and ribs previously described;
- means for connecting the apparatus to appropriate machinery, such as a robot arm; and
- means for providing vacuum to a substantial portion of the material or label the apparatus is transferring and depositing.

The apparatus may be constructed from a flexible material such as silicone. The benefits derived from this construction are two-fold. First, the apparatus will conform to the wall of a mold, thereby increasing accuracy in placement of the label or thin sheet material. Second, the flexibility of the material prevents scoring of the mold wall during placement.

In addition, the face of the apparatus may be substantially the same size and shape as the material being deposited. This design characteristic tends to minimize the deformations that occur in the material, resulting in greater accuracy of placement of the label.

In one embodiment of the invention, a central passageway may be created within the spine of the apparatus. This passageway is connected to a vacuum or suction source. The face of the apparatus is connected to the central passageway, and hence the vacuum via portholes. The vacuum is then dispensed over a substantial portion of the face by means of channels that radiate away from these portholes.

In another embodiment vacuum may be provided via a series of openings distributed over the face of the apparatus to hold the label to the face.

To the accomplishment of the foregoing and related ends, the invention, then, comprises the features hereinafter fully described and particularly pointed out in the claims. The following description and the annexed drawings set forth in detail a certain illustrative embodiment of the invention. This embodiment is indicative, however, of but one of the various ways in which the principles of the invention may be employed.

Although the invention is shown and described with respect to a preferred embodiment, it is obvious that equivalents and modifications will occur to others skilled in the art upon the reading and understanding of the specification. The present invention includes all such equivalents and modifications, and is limited only by the scope of the claims.

BRIEF DESCRIPTION OF THE DRAWINGS

This invention will be more readily understood by reading the following description with reference to the accompanying drawings, in which.

DETAILED DESCRIPTION OF THE PREFERRED EMBODIMENTS

Figure 1:
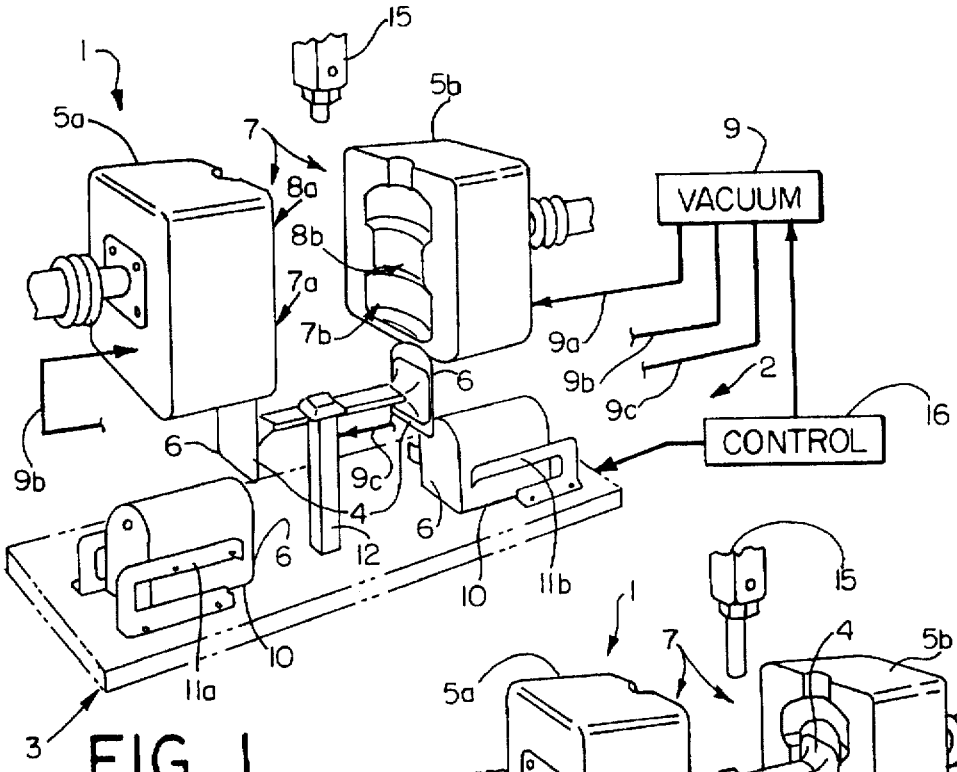
FIG. 1 is a schematic illustration of a blow molding machine with the mold sections open and a label transfer apparatus which already has picked up a pair of labels.
Figure 2:
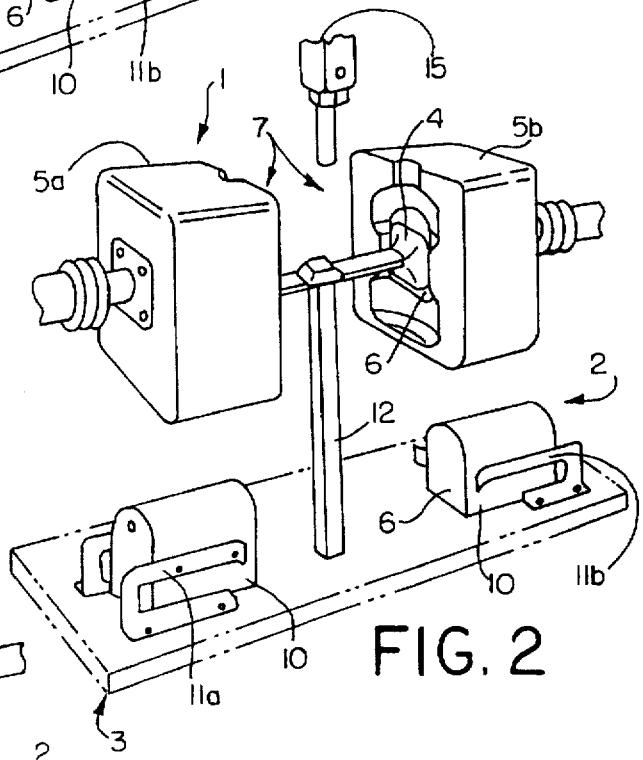
FIG. 2 is a schematic illustration of the blow molding machine of FIG. 1 with the labels being positioned in the respective mold sections.
Figure 3:
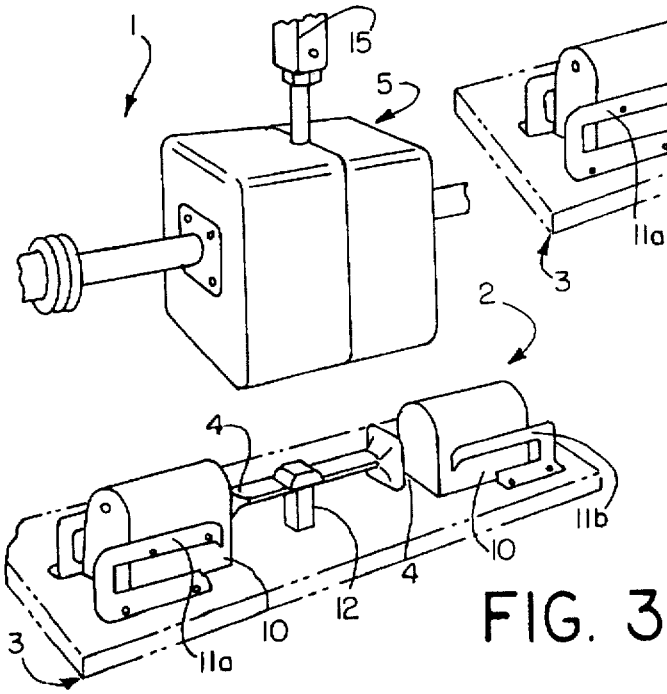
FIG. 3 is a schematic illustration of the blow molding machine of FIGS. 1 and 2 with the mold sections closed and with the label transfer apparatus positioned to pick up labels for the next sequence of molding operation.

Referring now to the drawings in which like reference numerals designate like parts, a blow-molding machine generally indicated by reference numeral 1 is shown in FIGS. 1, 2 and 3. The blow molding machine 1 includes an in-mold label dispenser 2 which utilizes a label transfer apparatus 3 having a label transfer carrier 4 in accordance with the present invention as is hereinafter described. The blow molding machine 1 also includes a mold 5 formed by a pair of mold halves 5*a*, 5*b*. The mold halves can be open as is shown in FIG. 1 to remove a molded part. While the mold 5 is open, labels 6 can be appropriately positioned therein, as is shown in FIG. 2. With the mold 5 closed, plastic may be injected into the mold cavity 7 and blown or expanded to make a part, as is shown in FIG. 3.

The mold cavity 7 is formed by cavity portions 7*a*, 7*b* in the respective mold halves 5*a*, 5*b*. Usually the mold cavity walls are not planar or flat; rather they typically have a curvature and often are stepped, e.g., at the top where a spout of molded bottle part joins the body portion of such bottle. Molded parts of different sizes and shapes usually require labels of correspondingly different sizes and shapes.

The label transfer carrier 4 of the invention is of a size and shape which preferably correspond to those of the label 6. Additionally, the label transfer carrier 4 has a substantially planar label support surface, as is described further below, to hold and to support a label 6 securely and without distortion. The label transfer carrier 4 further is flexible to deform generally to a shape which tends to match that of the respective mold cavity wall 8*b*, for example, as the label transfer carrier is brought into engagement with the mold cavity wall to deposit a label 6 thereon. Controlled vacuums from a vacuum source 9 are used to hold a label 6 on a label transfer carrier 4 and subsequently to hold a label on a mold cavity wall 8*b*, for example, on which the label has been positioned. Schematic vacuum line connections are depicted at 9*a*, 9*b*, 9*c*.

A supply 10 of labels 6 is provided on the label transfer apparatus 3, as is seen in FIGS. 1–3. The supply 10 includes a pair of cassettes 11*a*, 11*b* or other storage containers as supports for a plurality of labels. The cassette 11*a* may hold labels for one surface of the molded part and the cassette 11*b* may hold labels for a different surface. The label transfer apparatus 3 also includes a robot arm assembly 12 which supports the respective label transfer carriers 4 and moves them to respective cassettes to pick labels there and then to respective mold halves 5*a*, 5*b* to deposit the labels there.

FIG. 1 shows the first step of an in-mold labeling process. The mold halves 5*a*, 5*b* are open, and a plastic injection device 15 is disposed above mold halves 5*a*, 5*b* ready to inject the parison (plastic intended to be molded) after the labels 6 have been deposited on respective walls of the mold cavities 7*a*, 7*b*. A conventional control 16, such as a conventional computer control, controls automatic operation of the blow molding machine 1, label transfer apparatus 3, and various other parts described herein. Mold halves 5*a*, 5*b* are in an open position, ready to receive the labels 6. The robot arm assembly 12 of the label transfer apparatus 3 has disposed on each end a label transfer carrier 4 of the present invention. If a label is to be positioned on only one surface of the molded part, then the robot arm assembly 12 may have only one arm or, alternatively, no label is picked up by one of the arms thereof.

In operation of the blow molding machine 1 under control of the computer control 16, the mold 5 is opened, as is shown in FIG. 1, and the label transfer apparatus 3 is moving labels into the mold cavity 7. The control 16 causes the label transfer apparatus 3 to place labels into engagement with respective mold cavity walls 8*a*, 8*b*. As is seen in FIG. 2, the respective label transfer carriers 4 deform and press the labels 6 into engagement with the mold cavity walls 8*a*, 8*b*. The control 16 causes vacuum to be applied, e.g., via lines 9*a*, 9*b*, to respective mold halves 5*a*, 5*b* to retain the labels 6 in position and causes the vacuum in line 9*c* to be terminated so that the labels 6 are released from the label transfer carriers 4. The label transfer apparatus 3 then is moved to pick up more labels 6, as is shown in FIG. 3, and the mold 5 is closed to mold the part in conventional fashion. Subsequently, the mold 5 is opened and the molded part including integral labels is discharged, and the operation is repeated to make more parts.

As is shown in FIG. 1, the label transfer apparatus 3 has picked up labels 6 from cassettes 11*a*, 11*b*. The labels 6 are held in a substantially flat position against the respective label transfer carrier 4 by the controlled vacuum source 9. The robot arm assembly 12 moves the label transfer carriers 4 with the labels 6 from the respective cassettes 11*a*, 11*b* to the respective mold halves 5*a*, 5*b*. The robot arm assembly 12 pushes the label transfer carriers 4 against the respective mold cavity walls 8*a*, 8*b* as is shown in FIG. 2. The label transfer carriers 4 deform so as to conform to or to match the surface of the mold cavity walls 8*a*, 8*b* in order to ensure accurate placement of labels 6. The controlled vacuum from vacuum source 9 via vacuum line 9*c* holding labels 6 against label transfer carriers 4 is cut off when the label transfer carriers 4 are pressed against the mold cavity walls 8*a*, 8*b*. Vacuum from vacuum source 9 is applied via vacuum lines 9*a*, 9*b* through holes in the mold cavity walls 8*a*, 8*b* to remove labels 6 from their respective label transfer carrier 4 and affix the labels 6 to the respective mold cavity walls 8*a*, 8*b*. The robot arm assembly 12 is then removed from the mold 5 and returns to cassettes 11*a*, 11*b* to pick up labels 6 again, the first step in the next in-mold labeling process. The mold halves 5*a*, 5*b* are closed, as is shown in FIG. 3, and the plastic injection device 15 is lowered into the mold 5. A parison is blown into the mold 5. The labels 6 bond to the parison as a result of heat and pressure. As such, molding and labeling occur simultaneously.

The label transfer carrier 4 is shown in detail in FIGS. 4–8. The face 20 of the label transfer carrier 4 is configured in a shape and size which matches that of the label 6 to be transferred. The face 20 has channels 21 which radiate vertically and horizontally such that the face 20 is divided into surface area quadrants or sections 22. The channels 21 provide vacuum to a substantial portion of label 6. If desired, the channels 21 may be arranged diagonally, circularly, curved, or in some arrangement other than that shown in the drawings. Preferably the arrangement of channels 21 and surface area sections 22 provide sufficient vacuum to hold a label 6 securely without movement of the label; to avoid distortion of the label by being drawn into a channel; and/or to avoid damage to the label by a free unsupported edge of the label stock engaging another surface.

Preferably one or more channels 21 a generally circumscribe the perimeter of the face 20 inwardly spaced from an edge portion 22*a* of the face. Such channels 21*a* and edge portion 22*a* of the face tend to cooperate with the label 6 to seal or otherwise to hold the label fully extended, in planar flat engagement with other portions of the face 20. Such sealing function enhances accurate positioning of the label 6 on the label transfer carrier 4 and on a mold cavity wall 8*a*, or 8*b*.

Controlled vacuum is supplied to the channels 21, and hence to label 6, via a central passageway 23 and portholes 24. The central passageway 23 is located adjacent to the face 20 and runs the entire length of label transfer carrier 4. The portholes 24 are spaced equidistant along the central axis of the central passageway 23, thereby linking the channels 21 on the face 20 to the central passageway 23. A controlled vacuum is applied to the central passageway 23. As such, vacuum flows in the central passageway 23, through the portholes 24 and along the channels 21 so as to hold a label 6 to the face 20 of the label transfer carrier 4. Preferably the label 6 is held against and, thus, is supported by the surface area sections 22 and does not distort while being so held. Also, preferably the width of the channels 21 is sufficiently small as not to distort the label 6 by pulling the label 6 into a channel due to vacuum. Further, preferably there is a suitable frictional force provided by the face 20 of the label transfer carrier 4 to the label 6 to help resist movement of the label 6 relative to the face as the vacuum is applied via channels 21, as the label 6 is carried, by the label transfer apparatus 3 and as the label 6 is applied against a wall of the mold cavity 7. Thus, the material of the label transfer carrier 4, especially at face 20, preferably is not especially slippery and, more preferably has a sufficiently high coefficient of friction for the expressed purpose.

The shape of the label transfer carrier 4 preferably is the same or substantially the same as the shape of the label 6. Additionally, preferably the channels 21 extend along and about the entire or substantially the entire perimeter of the face 20 so that the label 6 is held securely not only at the approximate center of the label 6 but also about the entire perimeter of the label 6. Using multiple channels 21 which extend from the central passageway 23 and spine 30 and providing broad area of support of the label 6 by the support sections 22 help to obtain uniform distribution of vacuum over substantially the entire label 6. The label 6, therefore, is held accurately and securely and such accuracy and security are maintained as the label transfer carrier 4 is urged into deforming abutment with a mold cavity wall, 8*a* for example, thereby to obtain relatively accurate and clean (no folds, bends, tears, misalignments, etc.) positioning of the label 6 in the mold cavity 7.

Figure 8:
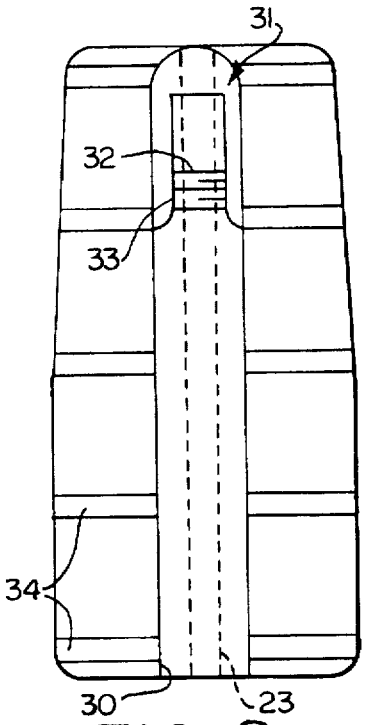
FIG. 8 is a back view of the label transfer carrier showing the spine and ribs.

In FIG. 8 the back view of the label transfer carrier 4 is seen. A spine 30 is centered on the vertical axis of the label transfer carrier 4 for flexible support thereof. The spine 30 is rectangular, but of non-uniform height, possessing a U-shape cutaway 31 running along a portion of the spine 30 to facilitate secure mounting to the robot arm assembly 12. The spine 30 also has a raised connection portion 32, which contains an aperture 33 running transversely therethrough. A pin-pivot arrangement is used to connect the label transfer carrier 4 to the robot arm assembly 12. The aperture 33 is designed to receive a pin (not shown) for connecting the label transfer carrier 4 to the robot arm assembly 12. The connection portion 32 may be reinforced to support the weight and operation of the label transfer carrier 4 and to avoid wear. For the accuracy of positioning on the mentioned pin and to facilitate manual manipulations of the label transfer carrier 4, the connection portion 32 may have a generally rectangular cross-section or shape, which also may improve strength and avoid wear, as was mentioned above.

The spine 30 has a central passageway 23 cut through substantially its entire length. The central passageway 23 is attached to a source of suction or vacuum 9, and serves as the central flow path for said vacuum or suction. Also shown in FIG. 8 are ribs 34, which run perpendicular to the central axis of the spine 30. The ribs 34 are tapered. The ribs 34 are thickest where they meet the spine 30, and become gradually thinner as they approach the edge of the label transfer carrier 4. Although tapered in this embodiment, the ribs 34 could also be of uniform height. Furthermore, the ribs 34 could run parallel to the spine 30, or at some angle between parallel and the perpendicular configuration shown.

The tapered ribs 34 preferably are located in the label transfer carrier 4 on the back side 35 thereof opposite a respective channel 21. The ribs 34, therefore, provide reinforcement for the label transfer carrier 4 to prevent the channels from changing cross-sectional shape, i.e., width, as vacuum is applied and as the label transfer carrier is pressed against a mold cavity wall, such as wall 8*b*. Therefore, the applied vacuum will be substantially uniform over the entire length of the channels 21 and face 20 of the label transfer carrier 4.

Due to the tapered shape of the ribs 34, such ribs are relatively more stiff adjacent the spine 30 and are less stiff and more flexible radially away or in any event a distance away from the spine 30. By increasing flexibility of the ribs 34 remotely of the spine 30, the face 20 is more easily deformed to follow the shape and contour of the mold cavity wall, such as wall 8*b*. Therefore, the label transfer carrier 4 is able to provide substantially full support of the label 6 as the label 6 is picked from a cassette 11*a*, 11*b*, is moved into the mold 5, and is placed securely into engagement with the mold cavity wall 8*a*, 8*b*. Accordingly, such placement is made accurately and ordinarily without damaging the label 6.

Figure 4:
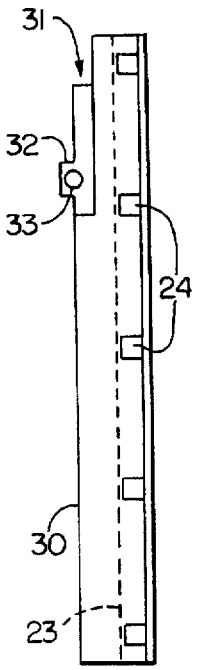
FIG. 4 is a side view of a label transfer carrier according to the invention.
Figure 5:
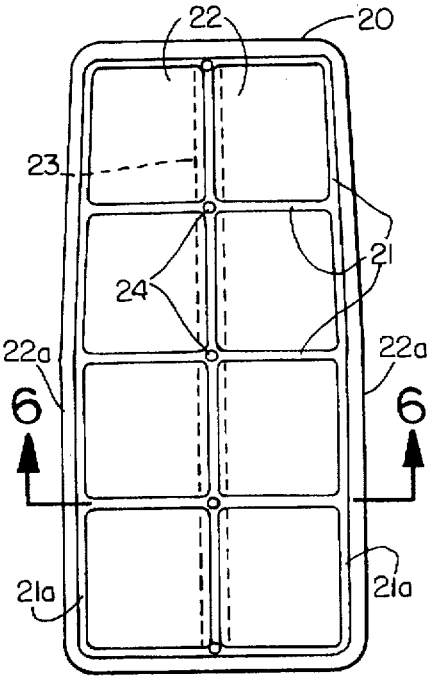
FIG. 5 is a front view of the label transfer carrier according to the invention.

FIG. 4 is a side view of label transfer carrier 4. The spine 30 has raised connection portion 32 in order to accommodate the aperture 33 which will be used for connecting the label transfer carrier 4 to the robot arm assembly 12. The U-shaped cutaway 31 is more clearly shown in this view. The cutaway 31 provides the space necessary for attachment of the label transfer carrier 4 to the robot arm assembly 12 via the aperture 33. The central passageway 23 may be plugged at one end, such as the same end of the label transfer carrier 4 as the U-shaped cutaway 31 is located. The vacuum source 9 is coupled to the other end of the central passageway 23. Portholes 24, used to connect the central passageway 23 to the face 20 of the label transfer carrier 4, are more clearly shown. The portholes 24 provide a path for the vacuum from central passageway 23 to the face 20 of the label transfer carrier 4.

Figure 7:
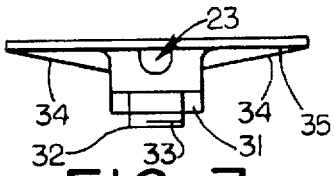
FIG. 7 is a top view of a label transfer carrier according to the invention.

FIG. 7 is a top view of the label transfer carrier 4. This figure more clearly illustrates how the ribs 34 taper, being thickest where they meet the spine 30 and gradually becoming thinner as they approach the edge of label transfer carrier 4. Moreover, FIG. 7 illustrates that central passageway 23 has a U-shape, with the opening of the U adjacent the back side of face 20.

The shape of central passageway 23 is only exemplary. The central passageway 23 could be circular or any other shape suitable for passage of vacuum or suction.

Figure 6:
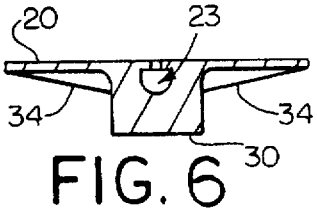
FIG. 6 is a section view of the label transfer carrier looking generally in the direction of arrows 6—6 in FIG. 5.

FIG. 6 is a sectional view of label transfer carrier 4. This figure illustrates that all portions of the label transfer carrier 4 may be made from the same material.

The label transfer carrier 4 preferably has a unibody construction. The entire label transfer carrier 4 is made out of the same material, such material being flexible in nature. This facilitates manufacturing. An example of a good material for construction of this transfer apparatus would be silicone. Silicone serves as a useful material for constructing the label transfer carrier 4 in that it is flexible so as to provide a relatively flat surface that will conform to the mold cavity walls 8*a*, 8*b* that the label 6 is being deposited on. In addition, silicone provides a non-stick surface which prevents the label 6 from sticking and thereby becoming attached to the label transfer carrier 4. However, the silicone material has suitable coefficient of friction characteristics to help avoid slippage of the label 6 relative to the label transfer carrier 4. Silicone, however, is not the only material that can be utilized for this label transfer carrier 4. Other materials could be flexible plastics, flexible metals, rubber, or any other suitable materials which are flexible and have a non-stick surface.

Figure 9:
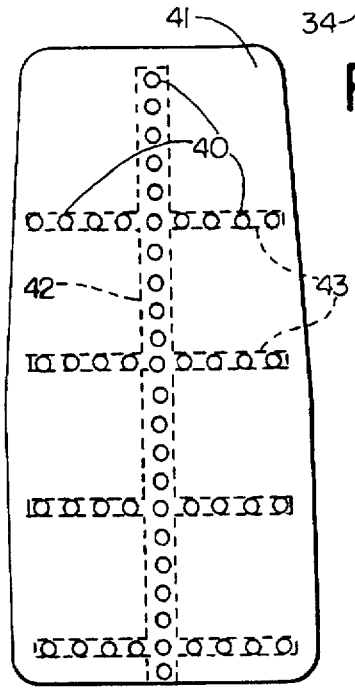
FIG. 9 is a front view of an alternative embodiment of the label transfer carrier showing a plurality of vacuum or suction holes.
Figure 10:
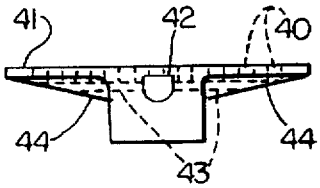
FIG. 10 is a bottom view of the alternative embodiment showing the vacuum channels running within the tapered ribs.

In another embodiment of this invention, illustrated in FIGS. 9 and 10, a plurality of holes 40 are contained on the face 41 of the label transfer carrier 4. The holes 40 are connected to the central passageway 42 via channels 43 contained within the ribs 44. As in the previous embodiment, the central passageway 42 is connected to a source of vacuum or suction. The holes 40 replace the channels previously described, and illustrated in FIG. 5. The holes 40 would be relatively small, generally considered pinholes, so as to avoid the label 6 being drawn into the holes 40, thereby distorting the label 6 and resulting in misplaced or misaligned labels.

The device according to the present invention offers numerous advantages over known devices. Since the apparatus is made of a flexible material, it has the capability of conforming to mold cavity walls 8*a*, 8*b* while depositing the label 6. In addition, this flexibility prevents any unnecessary scoring of mold cavity walls 8*a* and 8*b*, which may result in imperfections in the final molded product. Additionally, by providing a face 20 which conforms to the size and shape of the label 6 to be deposited, the label carrier 4 reduces the number of deformities occurring in the label 6, therefore minimizing inconsistencies in positioning of the label 6 on mold cavity walls 8*a* and 8*b*.

What is claimed is:

1. A thin sheet material carrier comprising:

a vacuum plate having a surface;

a plurality of ribs connected to said vacuum plate for supporting said vacuum plate;

a spine at least partly supporting said vacuum plate, and wherein said ribs taper from said spine to an edge of said carrier;

means for connecting said vacuum plate to a machine arm; and means for providing vacuum over a substantial portion of a thin sheet material, wherein said surface is configured in the same shape as said thin sheet material and has a generally flat surface area nearly equal to said thin sheet material's surface area.

2. A thin sheet material carrier according to claim 1, wherein said ribs are perpendicular to said spine.

3. A thin sheet material carrier according to claim 1, wherein said means for providing vacuum includes a plurality of holes distributed over said surface.

4. A thin sheet material carrier according to claim 1, wherein said means for providing vacuum includes a passageway, a plurality of portholes connecting said passageway to said surface and a plurality of channels in said surface and radiating from said portholes.

5. A thin sheet material carrier comprising:

a vacuum plate having a generally flat surface;

a plurality of ribs for supporting said vacuum plate;

a spine at least partly supporting said vacuum plate and wherein said ribs taper from said spine to an edge of said carrier;

means for connecting said vacuum plate to a machine arm; and means for providing a vacuum over a substantial portion of a thin sheet material wherein said means for providing vacuum includes a passageway, a plurality of portholes connecting said passageway to said surface and a plurality of channels radiating from said portholes.

6. A thin sheet material carrier according to claim 5, wherein said ribs are perpendicular to said spine.

7. A thin sheet material transfer carrier according to claim 5, wherein at least some of said channels run parallel to an edge of said surface to form a seal at said edge.

8. A thin sheet material transfer carrier according to claim 5, wherein said passageway is disposed within said spine.

9. A thin sheet material carrier comprising:

a vacuum plate having a generally flat surface;

a plurality of ribs for supporting said vacuum plate;

a spine at least partly supporting said vacuum plate and wherein said ribs taper from said spine to an edge of said carrier;

means for connecting said vacuum plate to a machine arm; and means for providing vacuum over a substantial portion of a thin sheet material, wherein said vacuum plate and ribs are made from a flexible material such that said thin sheet material carrier conforms to a wall of a mold.

10. A thin sheet material carrier according to claim 9, wherein said flexible material is silicone.

11. A thin sheet material carrier according to claim 9, wherein said ribs are perpendicular to said spine.

12. A thin sheet material carrier according to claim 9, wherein said means for providing vacuum includes a plurality of holes distributed over said surface.

13. A thin sheet material carrier according to claim 9, wherein said means for providing vacuum includes a passageway, a plurality of portholes connecting said passageway to said surface, and a plurality of channels in said surface and radiating from said portholes.

14. A thin sheet material sheet material carrier comprising:

a vacuum plate having a surface;

a plurality of ribs connected to said vacuum plate for supporting said vacuum plate;

means for connecting said vacuum plate to a machine arm; and means for providing vacuum over a substantial portion of a thin sheet material, wherein said surface is configured in the same shape as said thin sheet material and has a generally flat surface area nearly equal to said thin sheet material's surface area, wherein said means for providing vacuum includes a passageway, a plurality of portholes connecting said passageway to said surface and a plurality of channels in said surface and radiating from said portholes, and wherein at least one of said channels is substantially parallel to and overlying at least one of said ribs.

15. A thin sheet material carrier comprising:

a vacuum plate having a generally flat surface;

a plurality of ribs for supporting said vacuum plate;

means for connecting said vacuum plate to a machine arm; and means for providing vacuum over a substantial portion of a thin sheet material, wherein said vacuum plate and ribs are made from a flexible material such that said thin sheet material carrier conforms to a wall of a mold, wherein said means for providing vacuum includes a passageway, a plurality of portholes connecting said passageway to said surface, and a plurality of channels in said surface and radiating from said portholes, and wherein at least one of said channels is substantially parallel to and overlying at least one of said ribs.

* * * * *